US007409908B2

(12) United States Patent
Zuber

(10) Patent No.: US 7,409,908 B2
(45) Date of Patent: Aug. 12, 2008

(54) METHOD FOR TRANSPORTING PRINTING PLATES USING THE PLATE AND BLANKET CYLINDERS

(75) Inventor: Mathias Zuber, Helmstadt-Bargen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 442 days.

(21) Appl. No.: 11/122,879

(22) Filed: May 4, 2005

(65) Prior Publication Data

US 2005/0247227 A1 Nov. 10, 2005

(30) Foreign Application Priority Data

May 4, 2004 (DE) ..... 10 2004 022 213

(51) Int. Cl.
*B41F 27/12* (2006.01)

(52) U.S. Cl. ..... 101/477; 101/247

(58) Field of Classification Search ..... 101/477, 101/484, 247
See application file for complete search history.

(56) References Cited

U.S. PATENT DOCUMENTS

| | | | | |
|---|---|---|---|---|
| 4,041,862 A | | 8/1977 | Jiruse | 101/218 |
| 5,337,664 A | | 8/1994 | Hannon | 101/218 |
| 5,540,151 A | | 7/1996 | Ruckmann et al. | 101/477 |
| 5,617,792 A | * | 4/1997 | Rau et al. | 101/477 |
| 5,649,482 A | | 7/1997 | Hummel et al. | 101/218 |
| 5,649,487 A | | 7/1997 | Zuber | 101/477 |
| 5,701,822 A | * | 12/1997 | Metrope | 101/477 |
| 6,125,757 A | * | 10/2000 | Lemelin | 101/477 |
| 2007/0022885 A1 | * | 2/2007 | Zlatin et al. | 101/218 |

FOREIGN PATENT DOCUMENTS

| | | |
|---|---|---|
| DE | 26 14 514 A1 | 10/1976 |
| DE | 195 07 908 C2 | 9/1996 |
| DE | 195 13 378 A1 | 10/1996 |
| DE | 100 11 429 A1 | 9/2000 |
| DE | 101 58 484 A1 | 7/2002 |
| DE | 102 38 105 A1 | 3/2004 |
| JP | 6-270393 | 9/1994 |
| WO | 94/06630 | 3/1994 |

* cited by examiner

*Primary Examiner*—Leslie J Evanisko
(74) *Attorney, Agent, or Firm*—Laurence A. Greenberg; Werner H. Stemer; Ralph E. Locher

(57) ABSTRACT

An apparatus positions a plate cylinder and a blanket cylinder in a transport position for assisting in transporting printing plates. The apparatus spaces the blanket cylinder and plate cylinder apart from one another such that a pressure acting on a printing plate during the printing operation is reduced in the transport position. Optionally, one of the cylinders can be replaced with an inking and/or damping roller.

1 Claim, 2 Drawing Sheets

METHOD FOR TRANSPORTING PRINTING PLATES USING THE PLATE AND BLANKET CYLINDERS

BACKGROUND OF THE INVENTION

Field of the Invention

The present invention relates to a method and an apparatus for transporting plate-shaped material, in particular a printing plate, by use of cylinders of a printing press.

It is known, when feeding printing plates to the plate cylinder of a printing press or removing the used printing plate from the plate cylinder of the printing press, to use cylinders or rollers which interact with the plate cylinder during printing operation. This is, for example, the blanket cylinder or the ink or damping solution applicator rollers.

International patent disclosure WO 94/06630 (corresponding to U.S. Pat. No. 5,540,151) shows a plate cylinder of a rotary press, which plate cylinder interacts with one of the ink or damping solution applicator rollers when the used printing plate is removed, in order to transport the printing plate into a printing plate store.

During the transport of the printing plate by manipulating the contact pressure, as is required for the printing operation, it can lead to uncontrolled adhesion of the plate to the blanket cylinder or to the ink or damping solution applicator rollers, in particular during the transport of a used printing plate in conjunction with ink or detergent residues on the printing plate, and thus to interruptions of the unclamping procedure or even to damage being caused to the printing plate.

SUMMARY OF THE INVENTION

It is accordingly an object of the invention to provide a method and an apparatus for the transport of printing plates which overcome the above-mentioned disadvantages of the prior art methods and devices of this general type.

With the foregoing and other objects in view there is provided, in accordance with the invention, a method for transporting printing plates between two cylinders of a printing press which interact during a printing operation. The method includes using a plate cylinder and a blanket cylinder of the printing press as the two cylinders interacting during the printing operation. The plate cylinder and the blanket cylinder are positioned in a transport position for transporting the printing plates, spaced apart from one another such that pressure acting on a printing plate during the printing operation is reduced in the transport position. Instead of using the blanket cylinder, at least one ink and/or damping solution roller in place of the blanket cylinder.

It is a particular advantage of the invention that, in particular, the blanket cylinder is used for transporting the plates. The blanket cylinder has a throwing-on and throwing-off apparatus that is particularly suitable for modification to set a desired transport gap between the blanket cylinder and the plate cylinder, in order that the plate can be transported with a predefined pressure by the rotation of the two cylinders.

A particularly advantageous solution for producing the desired pressure relates to the reduction of the pivoting path of the blanket cylinder from a "thrown-off" or "service" position into the "thrown-on" or "operating" position by the arrangement of an adjustable stop. In one advantageous refinement, the adjustable stop can be actuated pneumatically and can thus be adjusted remotely, in particular can be adjusted remotely automatically. The stop is disposed on the actuating element for the blanket cylinder adjusting system.

Other features which are considered as characteristic for the invention are set forth in the appended claims.

Although the invention is illustrated and described herein as embodied in a method and an apparatus for the transport of printing plates, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENT

Figure 1:
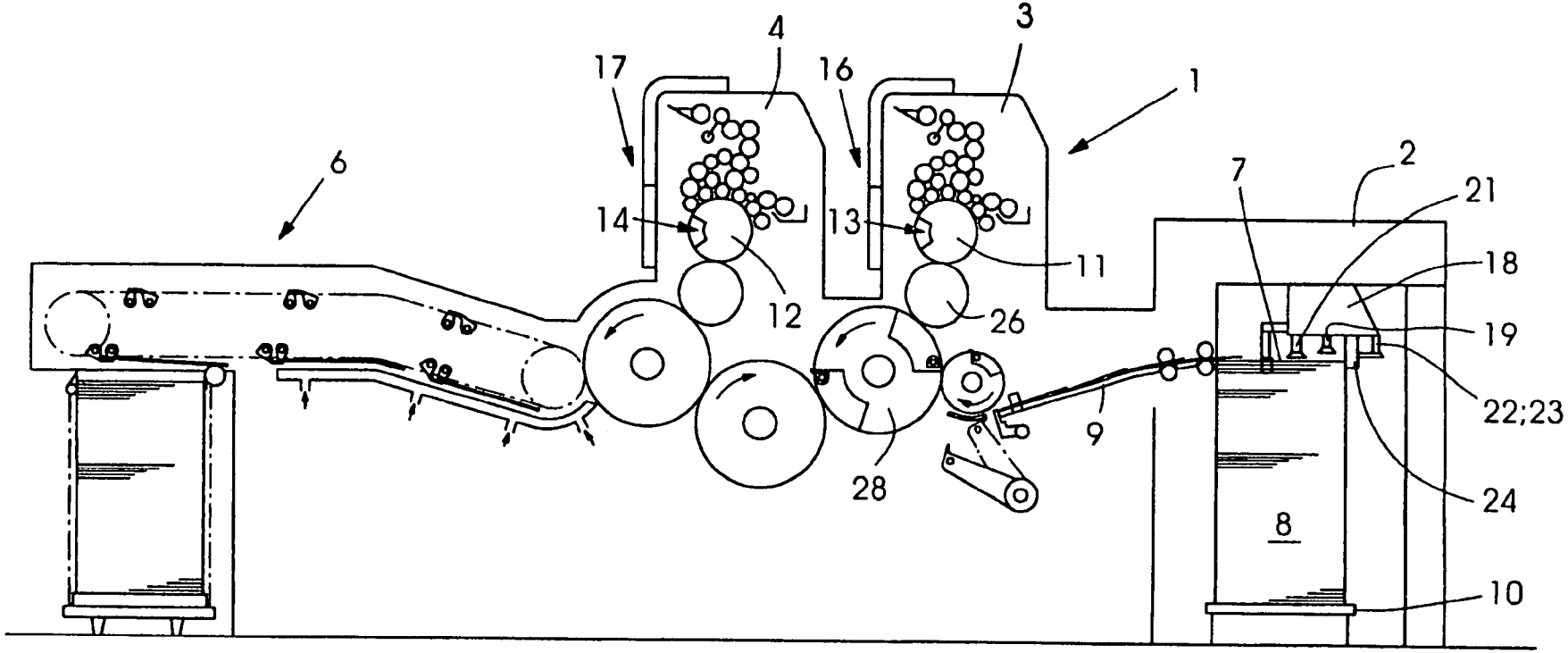
FIG. 1 is a diagrammatic, side-elevational view of a sheet-fed rotary printing press.

Referring now to the figures of the drawing in detail and first, particularly, to FIG. 1 thereof, there is shown a machine which processes sheets 7, for example a printing press 1. The printing press 1 has a feeder 2, at least one printing unit 3 and 4 and a deliverer 6. The sheets 7 are taken from a sheet stack 8 and, separated or overlapped, are fed over a feed table 9 to the printing units 3 and 4. The latter each contain a plate cylinder 11; 12 in a known manner. The plate cylinders 11 and 12 each have a device 13, 14 for fastening flexible printing plates. Furthermore, each plate cylinder 11; 12 is assigned a device 16; 17 for semiautomatic or fully automatic printing plate change.

The sheet stack 8 lies on a stack board 10 which can be raised under control. The removal of the sheets 7 takes place from the top of the sheet stack 8 by a suction head 18, as it is known, which inter alia has a number of lifting and dragging suckers 19, 21 to separate the sheets 7. Furthermore, blowing devices 22 for loosening the top sheet layers and sensing elements 23 for tracking the stack are provided. In order to align the sheet stack 8, in particular the top sheets 7 of the sheet stack 8, a number of side and rear stops 24 are provided.

Figure 2:
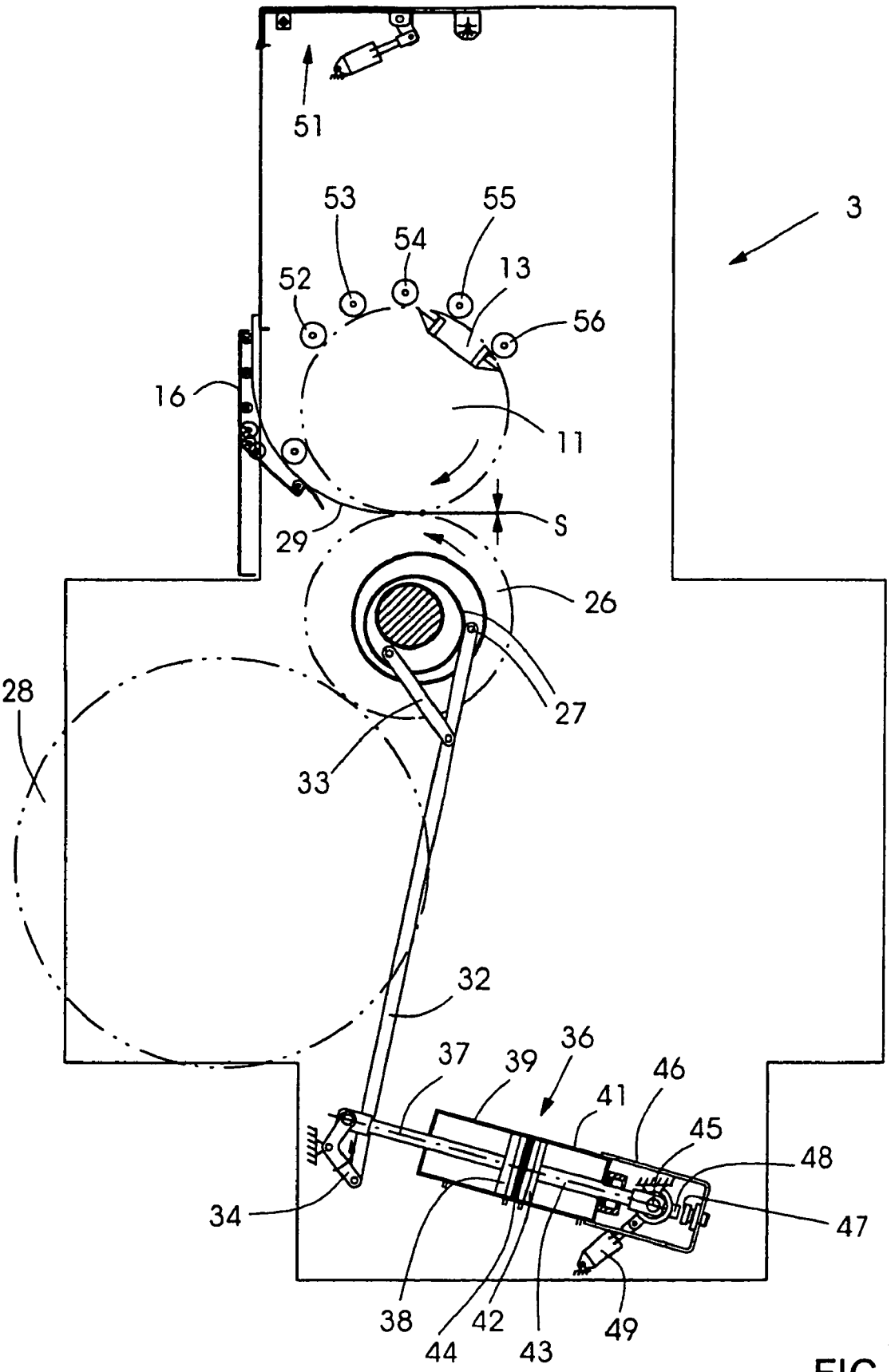
FIG. 2 is a diagrammatic, sectional view through a printing unit according to the invention.

FIG. 2 shows the first printing unit 3 with the plate cylinder 11 and a blanket cylinder 26 which can be moved into operative connection with the latter. The blanket cylinder 26 is mounted rotatably in side frames of the printing press 1, in each case by a double eccentric mounting 27. The blanket cylinder 26 can be pivoted by a first pivoting movement of the double eccentric mounting 27 from a "thrown-on" operating position into a service position or "thrown-off" position. In the "thrown-off" or service position, the blanket cylinder 26 is positioned without contact to the plate cylinder 11 and without contact to an impression cylinder 28.

In order to transport a printing plate 29, in particular in order to remove the used printing plate 29 from the plate cylinder 11, into a printing plate store device, disposed for this purpose ahead of the printing unit 3, of the printing plate changing device 16, the blanket cylinder 26 is pivoted by a pivoting movement of the double eccentric mounting 27 into a transport position. In the transport position, the blanket cylinder 26 is spaced apart from the impression cylinder 28 but is at a small transport gap S from the plate cylinder 11. The transport gap S is configured in such a way that a light transport pressure is exerted onto the printing plate 29 by the plate cylinder 11 and the blanket cylinder 26.

A linkage is provided to pivot the double eccentric mounting 27, which linkage contains a connecting rod 32 and a coupler 33 which is articulated on the former, the connecting rod 32 and coupler 33 each acting on one end on the double eccentric 27. A second end of the connecting rod 32 is articulated on a two-armed rocker arm 34 which is mounted pivotably on the side frame of the printing press. The pivoting movement is caused by an actuating element 36.

In the exemplary embodiment, the actuating element 36 is a double stroke cylinder 36 with a first piston rod 37 which is articulated on a second arm of the rocker arm 34 and has a first piston 38 at its end, which piston 38 is disposed in a first cylinder body 39. The first cylinder body 39 is adjoined by a second cylinder body 41 which has a second piston 42 with a second piston rod 43 disposed on it. The two cylinder bodies 39, 41 are connected to one another at their bases 44 and thus form a single component. That end of the piston rod 43 that lies opposite the second piston 42 is mounted pivotably on a bolt 45 which is fixed to the side frame. At the same time, the bolt 45 bears a pivotable stop 48 which interacts with an adjustable stop 47 which is fixed to the cylinder and disposed on a stop bracket 46.

The exhaust work of the cylinder 41 is limited, depending on the position of the stop 48. In order to limit the displacement path of the second cylinder 41, the stop 48 is pivoted out of a first position into a second position. The pivoting movement is produced by an operating cylinder 49 which is fastened to the side frame and can be acted on, for example, pneumatically. The operating cylinder 49 can be configured such that it can be adjusted remotely from the control desk of the machine as a function of the machine mode.

If the blanket cylinder 26 is to be moved into the "service position", both piston rods 37 and 43 are retracted fully. The operational positioning of the blanket cylinder 26 for continuous printing is carried out by the extending both of the first piston rod 37 and of the second piston rod 43. In this position, the stop 48 is pivoted away.

In the "transport position" for the printing plate 29, the blanket cylinder 26 is set away from the impression cylinder 28 and is situated in a relatively close position compared with the plate cylinder 11, which position forms the transport gap S. In this position, the operating cylinder 36 has a fully retracted first piston rod 37 and a partially extended piston rod 43. Here, the stop 48 is pivoted by the operating cylinder 49 in such a way that it interacts with the stop 47.

The printing plate 29 can then be transported under slight transport pressure, preferably transported away from the plate cylinder, by rotation of the plate cylinder 11 and the blanket cylinder 26. Here, an angled-away edge of the printing plate 29 passes into a holding device 51 which is configured to hold the printing plate 29, in accordance with German patent DE 195 07 908 C2 (corresponding to U.S. Pat. No. 5,649,487).

The blanket cylinder 26 is described merely as a preferred exemplary embodiment for transporting the printing plate in interaction with the plate cylinder 11. It goes without saying that it is also possible to use the ink applicator rollers 52, 53, 54, 55 or damping solution applicator rollers 56 individually or together or else together with the blanket cylinder 26 for transporting the printing plate 29, as long the rollers are positioned in a corresponding transport position, in which the spacing S is set between them and the plate cylinder 11.

This application claims the priority, under 35 U.S.C. § 119, of German patent application No. 10 2004 022 213.4, filed May 4, 2004; the entire disclosure of the prior application is herewith incorporated by reference.

I claim:

1. A method for transporting printing plates between two cylinders of a printing press which interact during a printing operation, which comprises the steps of:

using a plate cylinder and a blanket cylinder of the printing press as the two cylinders interacting during the printing operation; and positioning the plate cylinder and the blanket cylinder spaced apart from one another in a transport position for transporting the printing plates such that pressure of the plate cylinder and blanket cylinder acting on each printing plate in the transport position is reduced relative to the pressure of the plate cylinder and blanket cylinder acting on the printing plate during the printing operation, wherein each printing plate is transported with a predefined pressure by rotation of the plate cylinder and blanket cylinder.

* * * * *